US007086264B2

(12) United States Patent
Seidel et al.

(10) Patent No.: US 7,086,264 B2
(45) Date of Patent: Aug. 8, 2006

(54) COMBINED DRIVE FOR A FOUR-OR-SIX-HIGH ROLLING STAND AND AN OPERATING METHOD FOR THE SAME

(75) Inventors: Jürgen Seidel, Kreuztal (DE); Günter Kneppe, Hilchenbach (DE); Waldemar Wolpert, Dinslaken (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 323 days.

(21) Appl. No.: 10/381,169

(22) PCT Filed: Sep. 12, 2001

(86) PCT No.: PCT/EP01/10521

§ 371 (c)(1),
(2), (4) Date: May 6, 2003

(87) PCT Pub. No.: WO02/24362

PCT Pub. Date: Mar. 28, 2002

(65) Prior Publication Data

US 2003/0167817 A1 Sep. 11, 2003

(30) Foreign Application Priority Data

Sep. 20, 2000 (DE) ..... 100 46 426

(51) Int. Cl.
*B21B 31/08* (2006.01)
*B21B 35/00* (2006.01)

(52) U.S. Cl. ..... 72/249; 72/238; 72/241.2

(58) Field of Classification Search ..... 72/241.2, 72/249, 238, 444, 442, 199
See application file for complete search history.

(56) References Cited

U.S. PATENT DOCUMENTS

| | | | | | |
|---|---|---|---|---|---|
| 2,039,959 | A | * | 5/1936 | Iversen | 72/238 |
| 2,629,272 | A | | 2/1953 | Wood | |
| 4,478,064 | A | * | 10/1984 | Brenneman | 72/232 |
| 4,674,313 | A | | 6/1987 | Bald et al. | |
| 4,763,505 | A | * | 8/1988 | Klute et al. | 72/238 |
| 4,903,518 | A | * | 2/1990 | Kimura et al. | 72/249 |
| 5,363,682 | A | * | 11/1994 | Takeda et al. | 72/224 |
| 5,934,130 | A | * | 8/1999 | Kajiwara et al. | 72/249 |

FOREIGN PATENT DOCUMENTS

| | | | |
|---|---|---|---|
| DE | 34 11 853 | | 10/1985 |
| JP | 61159207 A | * | 7/1986 |
| JP | 62158588 A | * | 7/1987 |
| JP | 62197207 | | 8/1987 |
| JP | 09327704 | | 12/1997 |

* cited by examiner

*Primary Examiner*—Dmitry Suhol
(74) *Attorney, Agent, or Firm*—Andrew Wilford

(57) ABSTRACT

A roll stand has upper and lower rotatable working rolls defining a nip that pinches a workpiece strip and upper and lower vertically spaced rotatable backing rolls vertically flanking and engaging the working rolls. A drive includes a motor, upper and lower backing-roll outputs drivable by the motor, and upper and lower working-roll outputs also drivable by the motor. Respective upper and lower backing-roll and working-roll releasable connections are provided between the outputs and the respective rolls. When the working rolls are of large diameter, the backing-roll connections are released to disconnect the backing rolls from the drive and the working-roll connections are engaged to connect the working rolls to the drive and, when the working rolls are of small diameter, the working-roll connections are released to disconnect the working rolls from the drive and the backing-roll connections are engaged to connect the backing rolls to the drive.

2 Claims, 2 Drawing Sheets

COMBINED DRIVE FOR A FOUR-OR-SIX-HIGH ROLLING STAND AND AN OPERATING METHOD FOR THE SAME

CROSS REFERENCE TO RELATED APPLICATIONS

This application is the U.S. national phase of PCT application PCT/EP01/10521, filed 12 Sep. 2001, published 28 Mar. 2002 as WO 02/24362, and claiming the priority of German patent application 10046426.2 itself filed 20 Sep. 2000.

FIELD OF THE INVENTION

The invention relates to a four-high roll stand with two working rolls and two backing rolls driven via drive shafts, one of the backing rolls being connected via a releasable connection with a motor. The invention also relates to a six-high roll stand with two working rolls, two outer backing rolls, and two inner backing rolls between the outer backing rolls and the working rolls as well as to a method of selectively driving the four- or six-high roll stands with small- and large-diameter working rolls.

BACKGROUND OF THE INVENTION

A rolling string has one or more roll stands. The roll stands grip the workpiece strip with working rolls that are rotated oppositely to each other in the rolling direction. This rotation of the working rolls advances the workpiece. The height of the rolling nip determines the thickness to which the working rolls reduce the workpiece. A four-high roll frame (quarto) has two working rolls and two backing rolls. A six-high roll frame (sexto) has two working rolls, two outer backing rolls, and, between each outer backing roll and the respective working roll, an inner backing roll.

In order to roll very thin strip in a rolling string (hot or cold) small-diameter working rolls are used in the furthest downstream roll stand. They reduce the rolling force, the edge drop, and the temperature loss of the workpiece and also normally spare the roll stands of the rolling string because greater thickness reductions can be achieved.

Normally it is desirable to be able to hot roll not only very thin strip, but a thickness range from for example 0.8 mm to 12.7 mm. As a result of this requirement with respect to productivity, optimizing the roll string for thin strip is not possible for the following reasons:

Optimizing requires that for example the furthest two downstream roll stands with small-diameter working rolls be driven. The drive stubs and shafts of these small-diameter working rolls are often overloaded when rolling thick and/or hard strip. Switching out the small-diameter working rolls for large-diameter ones requires the drive shafts to be changed. The resultant down time of the rolling string is not acceptable.

German patent document 3,411,853 (US equivalent U.S. Pat. No. 4,674,313) describes a four- or six-high roll stand with driven backing rolls where the working rolls are driven frictionally by the backing rolls. In order to modify the operational characteristics of the rolling stand when it is driven at only a fraction of its capacity and such that the drive can be controlled accurately and loaded efficiently, it has been suggested that one of the drive motors be connected via a transmission with its backing roll and be uncoupled from this backing roll and shut down so that the load of the remaining drive motor is doubled and it can be controlled within the standard range more accurately.

The working rolls themselves have no drives but are in all case connected together by a synchronizing transmission so as to avoid any slip of the working rolls. Switching this type of rolling stand to large-diameter working rolls is neither foreseen nor possible, since it is impossible to drive the working rolls frictionally with a thicker strip exclusively from the backing rolls.

OBJECT OF THE INVENTION

Based on this state of the art, it is an object of the present invention to provide a rolling stand that permits a quick adaptation to strips of different thicknesses and/or hardnesses.

SUMMARY OF THE INVENTION

In order to simply be able to operate with small-diameter and large-diameter working rolls in the same stand, in a four-high stand according to the invention the other backing roll is also connected via a releasable connection with a motor and the two working rolls are each connectable via a releasable connection with the motor.

For a six-high rolling stand the outer backing rolls, inner backing rolls, and working rolls are driven by a motor through respective drive shafts that are each provided with a releasable connection.

This combined drive in a four- or six-high roll stand according to the invention makes it possible to couple large-diameter working rolls via the respective releasable connections directly with a motor while when small-diameter working rolls are used in a four-high roll stand the drive is effected via the two backing rolls which in this case are connected via releasable connections with the motor. The small-diameter working rolls are thus only driven by friction from the backing rolls. Similarly in a six-high roll stand in order to drive small-diameter working rolls only the outer backing rolls and/or the inner backing rolls are connected via the respective releasable connections with the motor while to drive large-diameter working rolls, these working rolls are themselves connected via the respective releasable connections with a motor.

According to the invention there is only a connection between a roll and the motor when torque is transmitted from the motor via, if necessary, an intermediate transmission and the releasable connection to the drive shaft. No connection to the motor as here defined is provided for the roll when it is driven by friction from another driven roll.

The releasable connections for connecting the working rolls with the motor are formed as clutches which can be of the mechanical, electrical, hydraulic, or pneumatic type.

The roll stand can be constructed such that the releasable connections for the drive stubs of the working rolls are couplings that can be fitted to and pulled off the drive shafts.

To this end the drive shafts can telescope to accommodate this type of connection. Finally it is advantageous and particularly interesting from a manufacturing point of view according to the invention when the small-diameter working rolls have no drive stubs so that the coupling on their drive spindles are ineffective. Thus in this case the coupling for the small-diameter working roll is separated from the drive shaft. The drive shafts for the working rolls thus run free.

Uniform and cost-effective driving of all the rolls is achieved when the two working rolls are connected to the working-roll motor via a transmission, in particular a continuous-mesh transmission. Alternately it is also possible when only the two working rolls are connected to a common working-roll drive motor via a transmission, in a particular a continuous-mesh transmission, while the backing rolls are provided with separate upper and lower drive motors.

The spacing between the backing rolls or the inner backing rolls is dependent on the diameter of the working rolls being used can be compensated for by appropriate adjustment devices, as for example stepped wedges at the upper and lower ends of the roll-stand frame.

Preferably the roll stands according to the invention use small-diameter working rolls with a low-friction coating, in particularly metallurgical powder (high-strength HSS rolls). These working rolls can be made by the HIP (hot isostatic pressing) technique.

BRIEF DESCRIPTION OF THE DRAWING

In the following the invention is described more closely with reference to a four-high roll stand. Therein.

SPECIFIC DESCRIPTION

Figure 1:
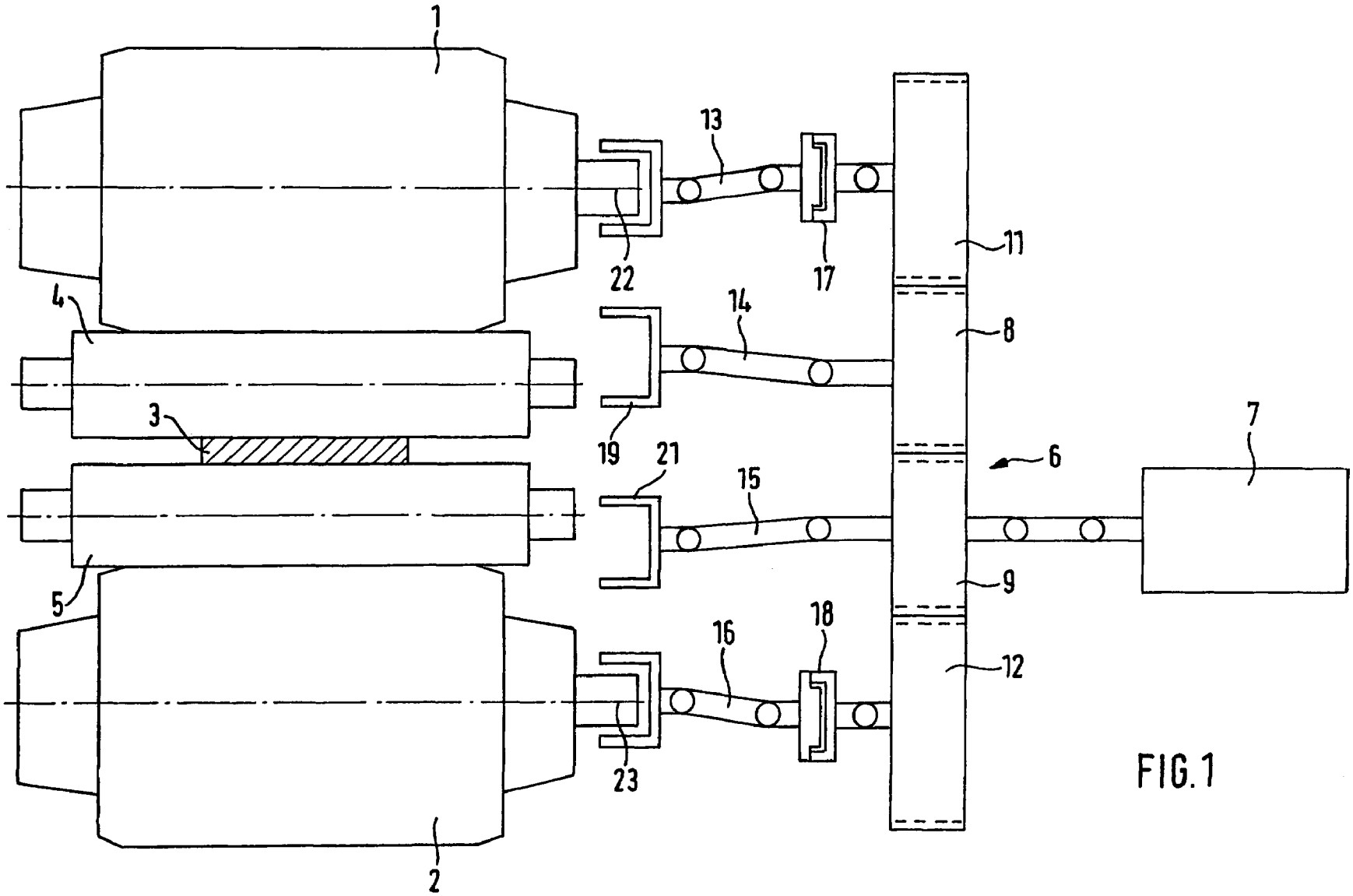
FIG. 1 is a four-high roll stand working with small-diameter working rolls.

FIG. 1 shows schematically backing rolls 1 and 2 of a four-high roll stand between which are small-diameter working rolls 4 and 5 for strip 3 of limited thickness.

In order to drive the rolls 1, 2, 4, and 5 there is a continuous-mesh transmission 6 driven by a drive motor 7. The continuous-mesh transmission 6 is comprised of two central working-roll gears 8 and 9 and upper and lower backing-roll gears 11 and 12.

The backing rolls 1 and 2 as well as the working rolls 4 and 5 have respective drive shafts 13, 14, 15, and 16 that are connected through the continuous-mesh transmission 6 with the motor 7. The drive shafts 13 and 16 for the backing rolls 1 and 2 have respective clutches 17 and 18 that can be opened to interrupt the transmission of torque between the motor 7 and the backing rolls 1 and 2.

In order to drive the small-diameter working rolls 4 and 5 shown in FIG. 1, the clutches 17 and 18 are closed in order to drive only the backing rolls 1 and 2, letting the working rolls 4 and 5 and their shafts 14 and 15 rotate freely. In the FIG. 1 embodiment with the small-diameter working rolls 4 and 5 couplings 19 and 21 are provided on the shafts 14 and 15 of the continuous-mesh transmission 6 that only serve to connect to drive stubs of large-diameter working rolls such as shown in below-discussed FIG. 2. Since the working rolls 4 and 5 of FIG. 1 have no drive stubs, there is no force transmission from the motor 7 to the working rolls 4 and 5. Thus when these small-diameter rolls 4 and 5 are used only the backing rolls 1 and 2 are connected via the respective connections or shafts 13 and 16 with the drive motor 7.

Figure 2:
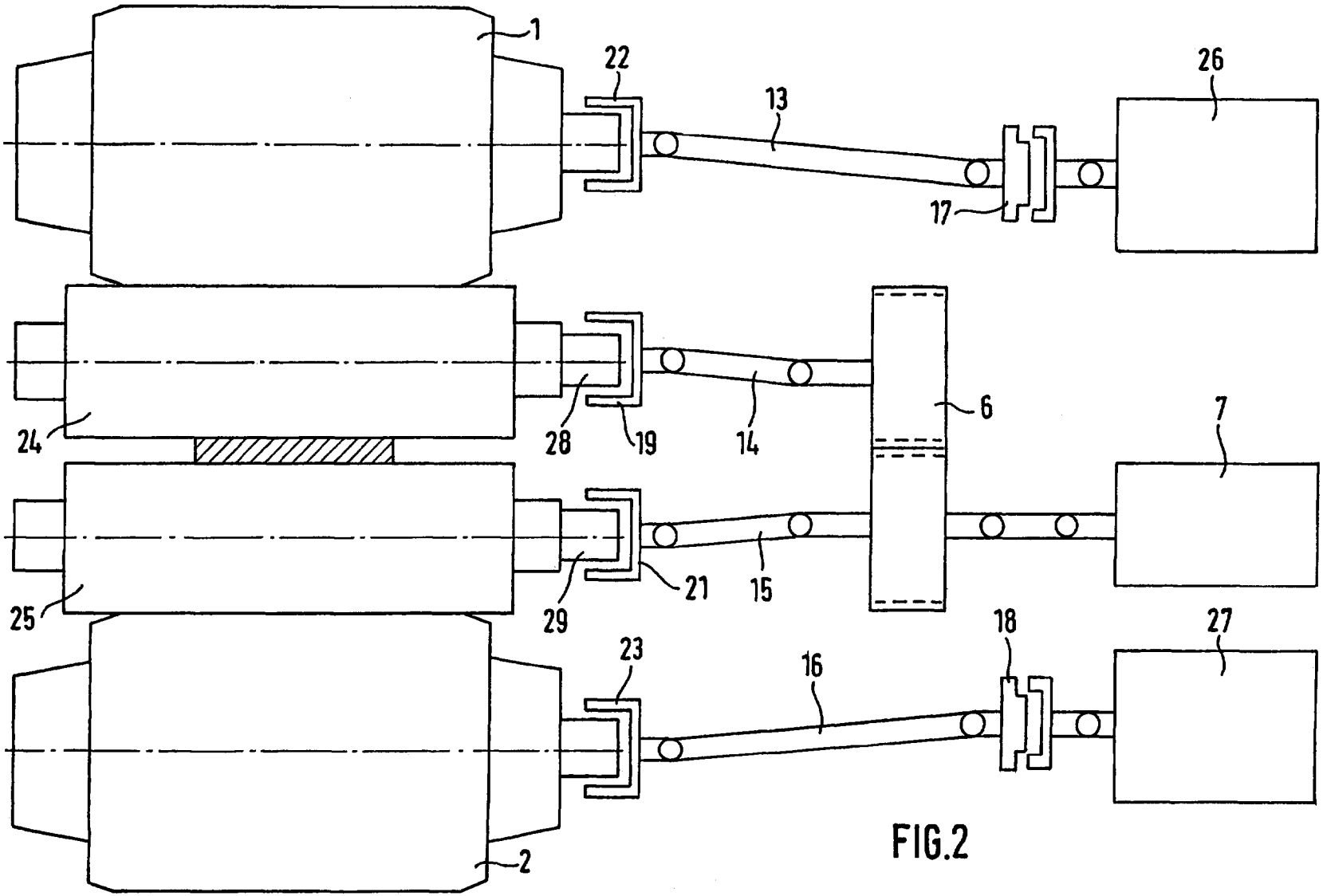
FIG. 2 is a four-high roll stand working with large-diameter working rolls.

If working conditions require, as shown in FIG. 2, large-diameter working rolls 24 and 25 can be used with no difficulty in the four-high roll stand according to the invention. The four-high stand of FIG. 2 is different from that of FIG. 1 in that the two backing rolls 1 and 2 are connected directly via their drive shafts 13 and 16 with separate respective backing-roll motors 26 and 27. This difference is however irrelevant to operation here.

The large-diameter working rolls 24 and 25 have drive stubs 28 and 29 that are connected to the couplings 19 and 21 of the drive shafts 14 and 15. Torque is transmitted to the large-diameter working rolls 24 and 25 via the spindles 14 and 15 and the continuous-mesh transmission 6 from the motor 7 which in this embodiment only drives the working rolls 24 and 25.

The clutches 17 and 18 for the drive shafts 13 and 16 of the backing rolls 1 and 2 are open when using large-diameter working rolls 24 and 25 as shown in FIG. 2 so that the backing rolls 1 and 2 idle and the backing-roll motors 26 and 27 can be shut off. Thus, when these large-diameter working rolls 24 and 25 are used, only the backing rolls 1 and 2 are connected to the drives 26 and 27 (or 7 in the FIG. 1 embodiment) and the working rolls 24 and 25 idle.

Of course it is also possible with the four-high stand according to FIG. 1 and FIG. 2 to provide clutches for the drive shafts 14 and 15 in order to interrupt torque transmission from the motor 7 to the working rolls when small-diameter working rolls 3 and 4 are being used.

In order to conform the spacing between the backing rolls 1 and 2 with the diameters of the working rolls 4 and 5 or 24 and 25, stepped wedges not illustrated in the drawing are provided on the upper and lower ends of the roll stand. All the drive shafts are formed as is known as cardan shafts in order to compensate for any offset between the axes of the driving and driven parts.

Thus the invention allows fast changing of rolling stock with respect to thickness and/or hardness in that the roll stand can be easily setup to work with both small- and large-diameter working rolls. The combined drive according to the invention in four- and six-high roll stands make it possible to connect large-diameter working rolls directly with a motor while small-diameter working rolls are driven only by friction from the adjacent backing rolls.

The invention claimed is:

1. A method of operating a roll stand comprising:

upper and lower vertically spaced rotatable outer backing rolls;

a pair of small-diameter working rolls;

a pair of large-diameter working rolls, each working-roll pair being fittable between the backing rolls;

a drive including a motor, upper and lower backing-roll outputs drivable by the motor, and upper and lower working-roll outputs also drivable by the motor;

respective upper and lower backing-roll releasable connections between the upper and lower backing rolls and the upper and lower backing-roll outputs; and upper and lower working-roll releasable connections connected to the upper and lower working roll outputs and connectable only to the large-diameter working rolls, the method comprising the steps of alternatively:

fitting only the large-diameter working rolls between the backing rolls, disconnecting the backing rolls from the drive, and connecting the large-diameter working rolls via the respective connections to the drive; and fitting the small-diameter working rolls between the backing rolls, disconnecting the small-diameter working rolls from the drive, and connecting only the backing rolls via the respective connections to the drive.

2. The roll-stand operating method defined in claim 1 wherein the stand further comprises:

inner backing rolls between the outer backing rolls and the respective working rolls, the drive having upper and lower inner backing-roll outputs drivable by the motor; and respective upper and lower inner backing-roll releasable connections between the upper and lower inner backing-roll outputs and the upper and lower inner backing rolls, the method further comprising the step of only connecting the inner backing rolls via the respective releasable connections to the drive when the working rolls are disconnected from the drive.

* * * * *